US009481487B2

(12) United States Patent
Dean et al.

(10) Patent No.: US 9,481,487 B2
(45) Date of Patent: Nov. 1, 2016

(54) REINFORCED MULTI-PIECE BLISS BOX

(71) Applicant: Georgia-Pacific Corrugated LLC, Atlanta, GA (US)

(72) Inventors: Christopher Evan Dean, Lilburn, GA (US); Yavuz Aksan, Suwanee, GA (US); Wayne P. Gasior, Duluth, GA (US); Ernest B. Widner, Gainesville, GA (US); Khurram Ali, Suwanee, GA (US)

(73) Assignee: GEORGIA-PACIFIC CORRUGATED LLC, Atlanta, GA (US)

( * ) Notice: Subject to any disclaimer, the term of this patent is extended or adjusted under 35 U.S.C. 154(b) by 0 days.

(21) Appl. No.: 14/239,096

(22) PCT Filed: Jan. 8, 2014

(86) PCT No.: PCT/US2014/010590

§ 371 (c)(1),
(2) Date: Feb. 14, 2014

(87) PCT Pub. No.: WO2014/110072

PCT Pub. Date: Jul. 17, 2014

(65) Prior Publication Data

US 2015/0041481 A1 Feb. 12, 2015

Related U.S. Application Data

(60) Provisional application No. 61/750,423, filed on Jan. 9, 2013.

(51) Int. Cl.

| | |
|---|---|
| ***B65D 5/32*** | (2006.01) |
| ***B65D 5/00*** | (2006.01) |
| ***B65D 5/54*** | (2006.01) |

(52) U.S. Cl.
CPC ..... *B65D 5/323* (2013.01); *B65D 5/001* (2013.01); *B65D 5/54* (2013.01)

(58) Field of Classification Search
CPC .... B65D 5/323; B65D 5/001; B65D 5/0015; B65D 5/002; B65D 5/548
USPC ..... 229/122.24, 122.25, 122.26
See application file for complete search history.

(56) References Cited

U.S. PATENT DOCUMENTS 2,588,232 A * 3/1952 Grant ..... B65D 5/323 229/117.06
3,100,072 A 8/1963 Mason (Continued)

FOREIGN PATENT DOCUMENTS

GB 744565 * 2/1956 ..... B65D 5/323
NL 9301699 A * 5/1995 ..... B65D 5/443
WO WO-2010/128874 A1 * 11/2010 ..... B65D 5/4266

OTHER PUBLICATIONS

International Search Report and Written Opinion dated May 12, 2014 (PCT/US2014/010590).

*Primary Examiner* — Gary Elkins

(57) ABSTRACT

The present application provides a multi-piece box. The multi-piece box may include a body blank with a number of body panels and a number of second blanks with a second blank panel. The second blanks may be attached to the body blank. One or more of the body panels may include a first dimension along a first direction, the second blanks may include a second dimension along the first direction, and the second dimension may be greater than the first dimension such that the second blank panels may create a protruding end with respect to the one or more body panels.

17 Claims, 7 Drawing Sheets

(56) References Cited

U.S. PATENT DOCUMENTS

| | | | | |
|---|---|---|---|---|
| 4,053,100 | A | 10/1977 | Baptist | |
| 4,101,048 | A | 7/1978 | Rieben et al. | |
| 4,645,122 | A * | 2/1987 | Nederveld | B65D 5/005 206/509 |
| 5,085,367 | A | 2/1992 | Carstens | |
| 5,450,998 | A * | 9/1995 | Esse | B65D 5/606 229/117.27 |
| 5,671,883 | A | 9/1997 | Philips | |
| 5,918,801 | A | 7/1999 | Milio | |
| 6,186,393 | B1 * | 2/2001 | Tsamourgelis | B65D 5/32 229/122.21 |
| 6,279,818 | B1 | 8/2001 | Kim et al. | |
| 6,598,785 | B2 | 7/2003 | Quaintance | |
| 6,719,191 | B1 * | 4/2004 | Christensen | B65D 5/0075 206/509 |
| 7,303,114 | B2 * | 12/2007 | McKenna, Sr. | B65D 5/2076 229/117.13 |
| 8,408,452 | B2 * | 4/2013 | Churvis | B65D 5/28 229/108 |
| 2005/0075230 | A1 | 4/2005 | Moshier et al. | |
| 2010/0140336 | A1 | 6/2010 | Ho Fung | |
| 2016/0068298 | A1 | 3/2016 | Westney et al. | |

* cited by examiner

REINFORCED MULTI-PIECE BLISS BOX

TECHNICAL FIELD

The present application and the resulting patent relate generally to a box or a carton and more particularly relate to a corrugated multi-piece bliss box with one or more strength reinforcing features for improved compression strength.

BACKGROUND OF THE INVENTION

Corrugated boxes and cartons are in wide use to pack, ship, store, and/or display many different types of products. Specifically, these boxes and cartons should securely retain and protect the products therein during shipping and storage while providing easy access to the products for later display and/or removal. Moreover, existing supply chain requirements also should be met so as to ensure efficient production, transport, and use of the box or carton across one or more industries or across one or more geographies.

One popular style of a box or a carton is known as a bliss box. A bliss box may be formed from multiple blanks. Specifically, a main body blank may be joined to the one or more secondary blanks. This style of box is popular, in part, because the products therein may be readily displayed, i.e., the bliss box may be converted to a configuration that allows the products inside the box to be seen. Known bliss box designs may have a wide variety in both construction and materials. Bliss boxes typically are used for products that require high top to bottom stacking strength such as for plastic bottles and the like. Although known bliss boxes typically have considerable stacking strength, further strength improvements would be helpful and would provide additional versatility in use.

There is thus a desire for an improved bliss box design. Preferably such a bliss box design may provide the versatility of known bliss box designs with reinforced strength for superior stacking and shipping with the use of a reduced amount of corrugated material.

SUMMARY OF THE INVENTION

The present application and the resultant patent thus provide a multi-piece box. The multi-piece box may include a body blank with a number of body panels and a number of second blanks with a second blank panel. The second blanks may be attached to the body blank. One or more of the body panels may include a first dimension along a first direction, the second blanks may include a second dimension along the first direction, and the second dimension may be greater than the first dimension such that the second blank panels may create a protruding end with respect to the one or more body panels.

The present application and the resultant patent further provide a multi-piece bliss box. The multi-piece bliss box may include a body blank with a pair of side panels and a pair of end panel blanks with an end panel. The end panel blanks may be attached to the body blank. The end panels may include a protruding end with respect to the pair of side panels.

The present application and the resultant patent further provide a multi-piece bliss box. The multi-piece bliss box may include a pair of side panels with a vertical fold line and a pair of end panels with a protruding end with respect to the pair of side panels.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
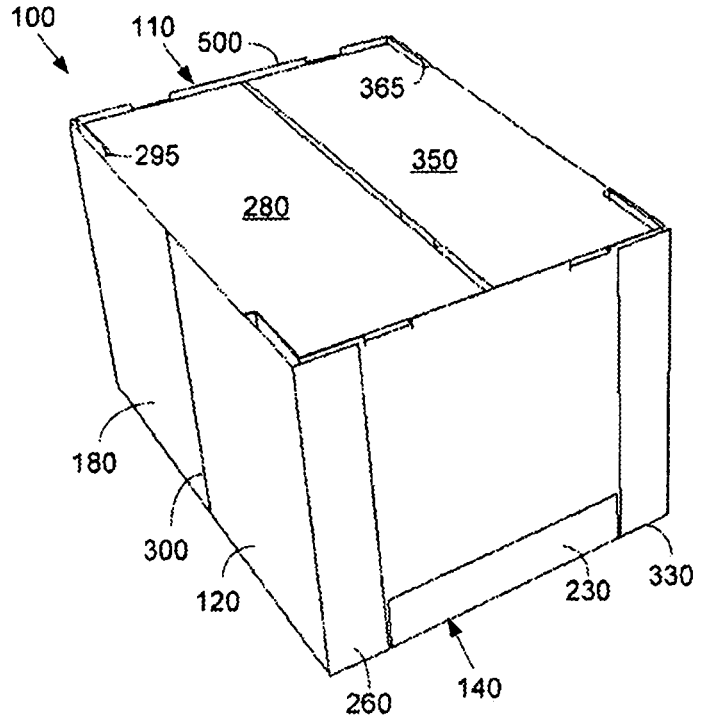
FIG. 1 is a perspective view of an example of a bliss box as may be described herein.
Figure 2:
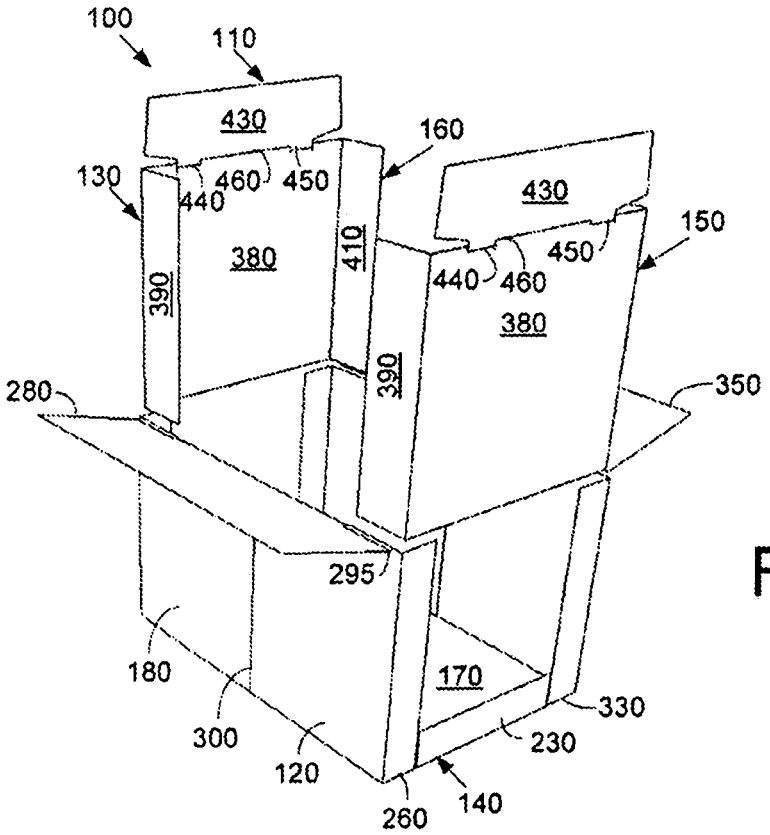
FIG. 2 is an exploded view of the bliss box of FIG. 1.

Referring now to the drawings, in which like numerals refer to like elements throughout the several views, FIGS. 1 and 2 show an example of a box 100 as may be described herein. In this example, the box 100 may be a bliss-style box 110 as will be described in more detail below. The box 100 may contain any number or any type of products therein. In describing the box 100, the terms "bottom," "top," "side," "end," and the like are used for purposes of relative orientation only and not as absolute positions. For example, any surface of the box 100 may be used as the bottom or the top as oriented by a user. Further, the terms "length," "width," "height," and the like refer to relative orientations. Similarly, the term "box" is meant to encompass "cartons," "containers," and any other type of enclosure as well as partial or non-continuous enclosures.

The box 100 may be made out of corrugated paperboard stock 120 and the like. The corrugated paperboard stock 120 may be recyclable. The corrugated paperboard stock 120 may have a single wall construction and may be coated or uncoated. In this example, the coated paperboard stock 120 may be a "C-Flute" type corrugated board with about thirty-nine (39) flutes per linear foot and a vertical orientation. Other types of corrugated paperboard stock 120 such as double wall constructions and the like also may be used. Other suitable types of substrates also may be used herein. Different types of corrugated paperboard stock 120 or other materials also may be used herein with respect to the several blanks as will be described in more detail below. The box 100 may have any suitable overall size. The size of the box 100 may be standard according to the intended industry, intended geography, or other type of use parameter. Any suitable type of graphics, messaging, and other types of indicia may be printed or otherwise applied to the box 100.

Figure 3:
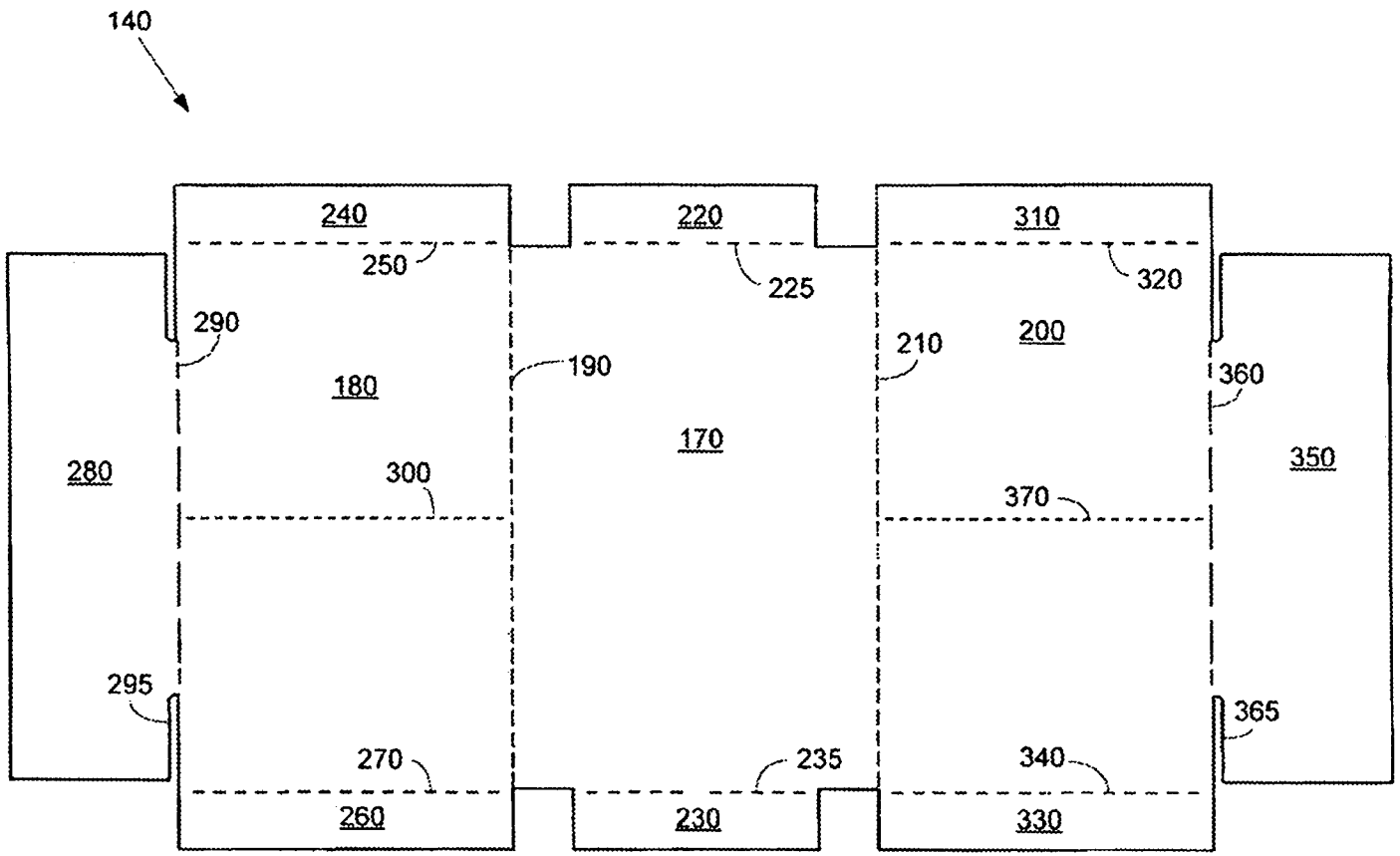
FIG. 3 is a plan view of a body blank that may be used to construct the bliss box of FIG. 1.
Figure 4:
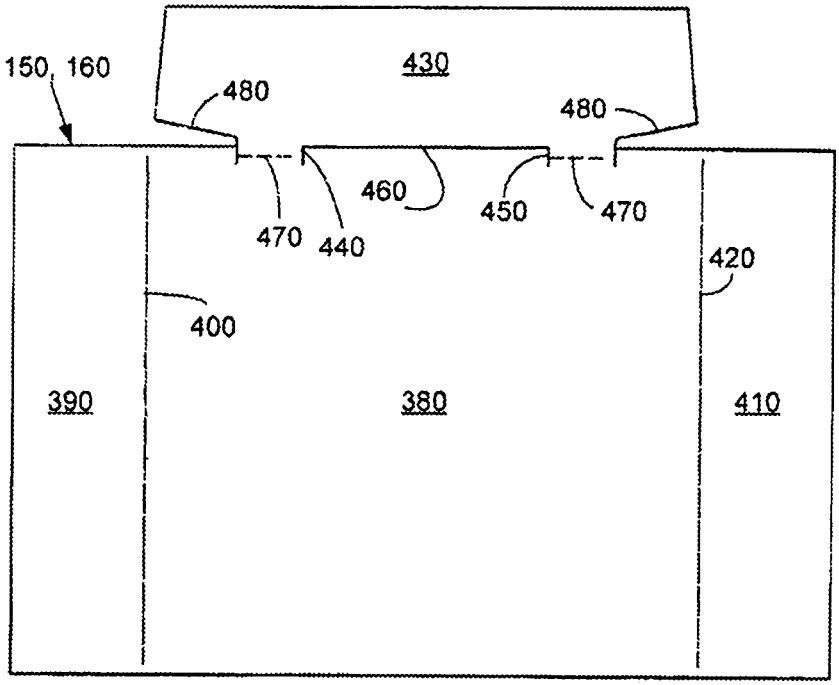
FIG. 4 is a plan view of an end panel blank that may be used to construct the bliss box of FIG. 1.
Figure 5:
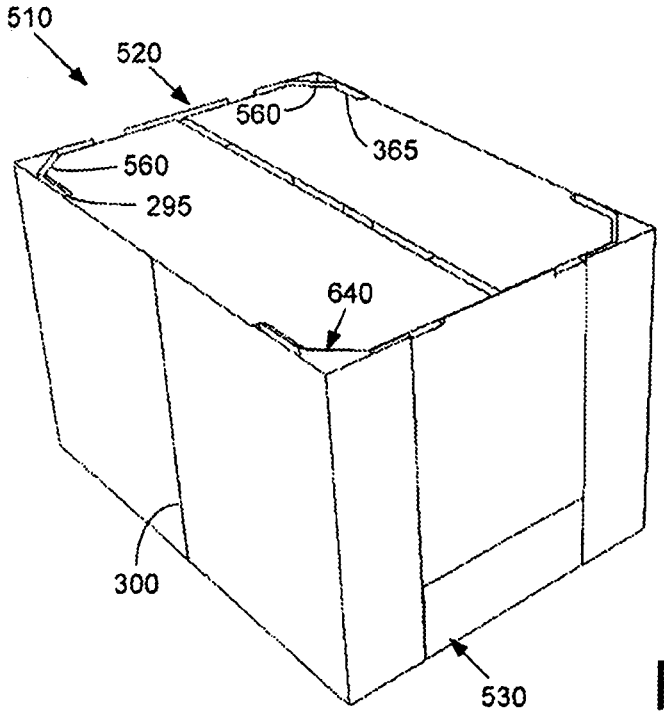
FIG. 5 is a perspective view an example of an alternative embodiment of a bliss box as may be described herein.
Figure 6:
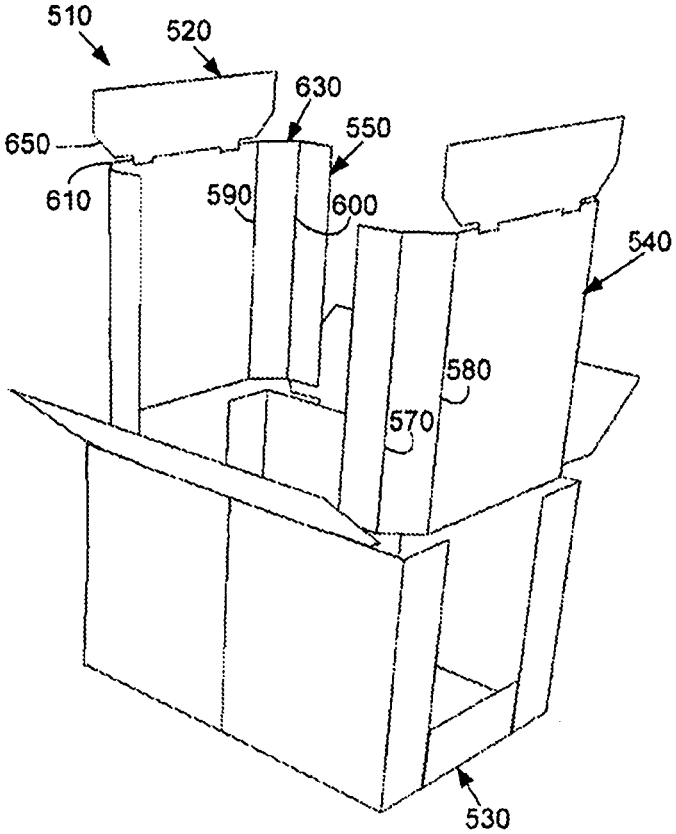
FIG. 6 is an exploded view of the bliss box of FIG. 5.
Figure 8:
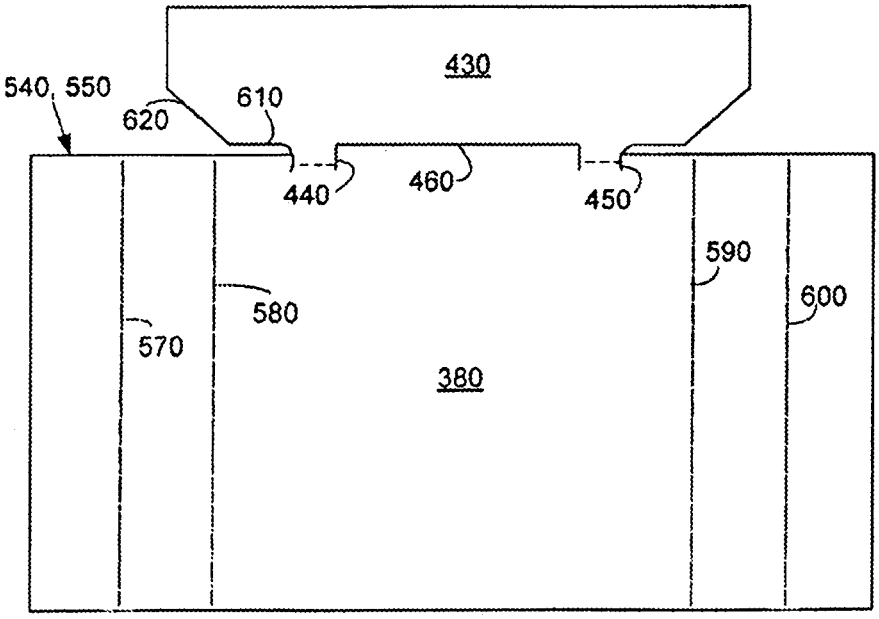
FIG. 8 is a plan view of an end panel blank that may be used to construct the bliss box of FIG. 5.
Figure 7:
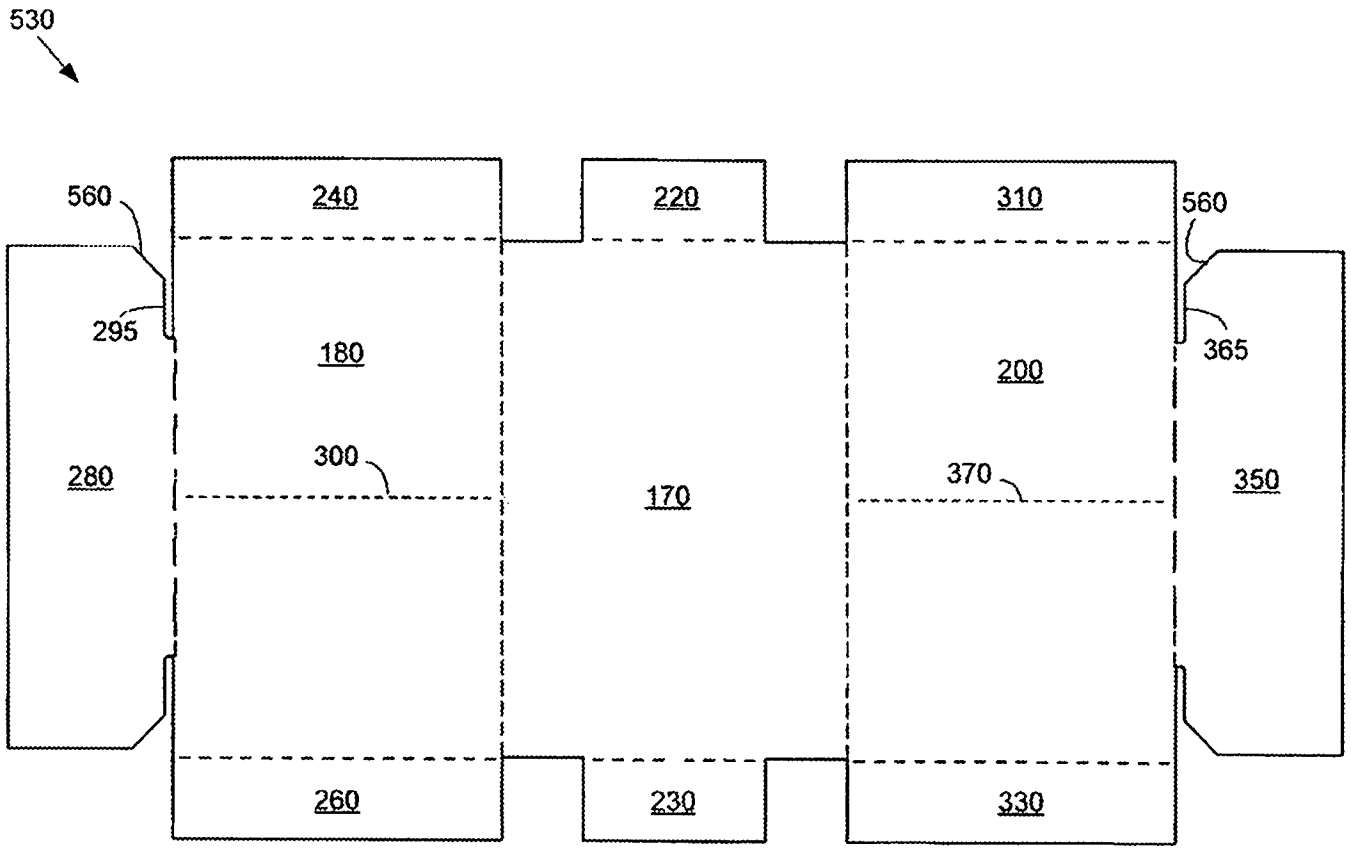
FIG. 7 is a plan view of a body blank that may be used to construct the bliss box of FIG. 5.

The box 100 may be a multi-piece box 130. As is shown in FIGS. 3 and 4, the box 100 may include a body blank 140 and a number of secondary blanks. In this example, a first end panel blank 150, and a second end panel blank 160 are shown. Other types and numbers of blanks may be used herein. The blanks may include a number of fold lines therein. It will be understood that the fold lines may be formed by crushing or scoring the corrugated paperboard stock 120 along the line to be folded so as to facilitate bending and forming of the various panels and flaps herein. The term "fold line" may be used interchangeably with the terms "tear lines", "score lines", "perforated lines", and the like. Other suitable types of construction techniques also may be used herein. The blanks may be of any suitable size. The blanks may be attached to one another by a conventional adhesive as well as by stapling and other suitable types of attachment methods.

The body blank 140 may include a floor panel 170. A first side panel 180 may be attached to the floor panel 170 by a fold line 190 while a second side panel 200 may be attached by a fold line 210. The floor panel 170 also may be attached to a first glue flap 220 by a fold line 225 and a second glue flap 230 by a fold line 235. The first side panel 180 may include a first side panel first flap 240 attached by a fold line 250 and a first side panel second flap 260 attached by a fold line 270. The first side panel 180 also may be attached to a first top flap 280 via a fold line 290 and a pair of slots 295. The slots 295 may be an area of slight separation from the first side panel 180. The size, shape, and configuration of the blanks, the panels, the flaps, and the slots may vary herein.

The first side panel 180 also may be divided, in whole or in part, by a first vertical fold line 300. The first vertical fold line 300 may extend from the fold line 190 about the floor panel 170 to the fold line 290 about the first top flap 280. The first vertical fold line 300 may be positioned about the middle of the first side panel 180 or elsewhere thereon. The first vertical fold line 300 may take the form of a score line, a line of perforations, and/or a line of scores and perforations. Different types of vertical fold lines, score lines, lines of perforations, lines of combinations of scores and perforations, and the like may be used herein. The first vertical fold line 300 may or may not be completely linear along its length. The first vertical fold line 300 may be continuous or intermittent. Different types of vertical fold lines 300 may be used herein. Multiple first vertical fold lines 300 may be used. Other components and other configurations also may be used herein.

The second side panel 200 may include a second side panel first flap 310 attached by a fold line 320 and a second side panel second flap 330 attached by a fold line 340. The second side panel 200 also may be attached to a second top flap 350 by a fold line 360 and a pair of slots 365. The slots 365 may be an area of slight separation from the second side panel 200. The size, shape, and configuration of the blanks, the panels, the flaps, and the slots may vary herein The second side panel 200 also may be divided, in whole or in part, by a second vertical fold line 370. The second vertical fold line 370 may extend from the fold line 210 about the floor panel 170 to the fold line 360 about the second top flap 350. The second vertical fold line 370 may be positioned about the middle of the second side panel 200 or elsewhere thereon. The second vertical fold line 370 may take the form of a score line, a line of perforations, and/or a line of scores and perforations. Different types of vertical fold lines, score lines, lines of perforations, lines of combinations of scores and perforations, and the like may be used herein. The second vertical fold line 370 may or may not be completely linear along its length. The second vertical fold line 370 may be continuous or intermittent. Different types of vertical fold lines 370 may be used herein. Multiple second vertical fold lines 370 may be used. Other components and other configurations also may be used herein.

FIG. 4 shows an example of the first end panel blank 150 (with the second end panel blank 160 being identical). Each end panel blank 150, 160 may include an end panel 380. The end panels 380 may include a first end panel side flap 390 attached by a fold line 400 and a second end panel side flap 410 attached by a fold line 420. The end panels 380 also may be attached to an end panel top flap 430 by a first recessed hinge 440, a second recessed hinge 450, and a top flap fold line 460. As will be described in more detail below, the top flap fold line 460 forms an exposed or protruding end when folded over. Each recessed hinge 440, 450 also may include a hinge fold line 470 slightly offset from the top flap fold line 460. Any number of the recessed hinges 440, 450 may be used herein. The end of the end panel top flap 430 may have an angled configuration 480 about the recessed hinges 440, 450. Any suitable angle may be used herein. Other components and other configurations also may be used herein.

To construct the box 100, the side panels 180, 200 may be folded about the floor panel 170 and the flaps 240, 260, 310, 330 may be folded about the side panels 180, 200. The glue flaps 220, 230 may be folded about the floor panel 170. Likewise, the end panel side flaps 390, 410 may be folded about the end panel 380 of each end panel blank 150, 160. The end panel blanks 150, 160 may be positioned within the body blank 140 as folded above and may be attached via conventional adhesive or other types of attachment methods. The order of the assembly steps may vary. Other, fewer, or additional assembly steps also may be used herein.

The box 100 may then be filled with the products therein. The end panel top flaps 430 may be folded downward about the recessed hinges 440, 450. The end panel top flaps 430 may be enclosed, in whole or in part via the top flaps 280, 350. The end panel top flaps 430 and the top flaps 280, 350 also may be attached via a conventional adhesive or other types of attachment methods.

The box 100 also includes a number of strength enhancing features. The box 100 may include a pair of protruding end portions 500. Specifically, the end panels 380 and the flaps 390, 410 of the end panel blanks 150, 160 may be somewhat greater in length as compared to the side panel 180, 200 and the side panel flaps 240, 260, 310, 330 of the body blank 140. The slots 295, 365 allow the end panels 380 and the side flaps 390, 410 of the protruding end panels 500 to extend therethrough. This protruding end panel 500 configuration may assist in initial load bearing by extending the end panel blanks 150, 160 beyond the side panels 180, 200 so as to accommodate a load thereon before the side panels 180, 200 are also compressed.

The box 100 also has the vertical fold lines 300, 370 extending along the length of the side panels 180, 200. (By the term "vertical fold line" we mean substantially parallel to the flute orientation.) These vertical fold lines 300, 370 also may aid in overall top to bottom compression. Specifically, the vertical fold lines 300, 370 strengthen the side panels 180, 200 by subdividing the panels so as to reduce panel buckling while under load. The vertical fold lines 300, 370 may increase the compression strength by making the side panels 180, 200 (or other panels) more resistant to deformation or buckling. Specifically, the vertical fold lines 300, 370 may provide for controlled buckling/deformation in a specified direction. The vertical fold lines 300, 370 may allow the side panels 180, 200 to bend in an opposite direction to the natural direction during top to bottom compression. The type, number, and configuration of the vertical fold lines 300, 370 may vary. Other components and other configurations also may be used herein.

Previous cartons may have used either non-vertical fold lines and/or incomplete fold lines so as promote failure or bulging in a predetermined manner, so as to prevent pallet overhang and the like. The vertical fold lines 300, 370 described herein increase overall top to bottom compression strength so as to prevent or limit failure or bulging.

The protruding end panels 500 and the vertical fold lines 300, 370 may combine so as to provide additional top to bottom compression strength to the box 100. These features may provide a box 100, particularly a bliss-style box 110, with the improved stack-ability and a reduction in material. These features may be used individually or in combination.

FIGS. 5-8 show an alternative embodiment of a box 510 as may be described herein. Similarly to that described above, the box 510 may be a bliss-style box 520. The box 510 may include a body blank 530, a first end panel blank 540, and a second end panel blank 550. The body blank 530 may be similar to the body blank 140 described above except that the first top flap 280 and the second top flap 350 may have an angled configuration 560 positioned about the slots 295, 365. Any suitable angle may be used herein. Likewise, the end panel blanks 540, 550 may be similar to the end panel blanks 150, 160 described above except that a number of additional fold lines may be used to form any suitable number of side flaps. Specifically, the end panel 380 may have a first side first fold line 570, a first side second fold line 580, a second side first fold line 590, and a second side second fold line 600. Any suitable number of fold lines may be used herein. Likewise, instead of the angled configuration 480, the end panel top flaps 430 may include a slot 610 and an angled configuration 620. Any suitable angle may be used herein. The slots 610 and the angled configuration 620 may be sized to accommodate the end panels 380 extending therethrough. Other components and other configurations may be used herein.

When the panel blanks 540, 550 are positioned within the body blank 530, the end panels 380 may be folded along the fold lines 570, 580, 590, 600 into an angled configuration 630. Specifically, the end panels 380 extend through the angled configurations 560 and the slots 290, 365 to form an angled protruding end 640. The angled protruding end 640 also may assist in initial load bearing with the angled configuration 630 aiding in distributing the load thereon. Other components and other configurations may be used herein.

Figure 10:
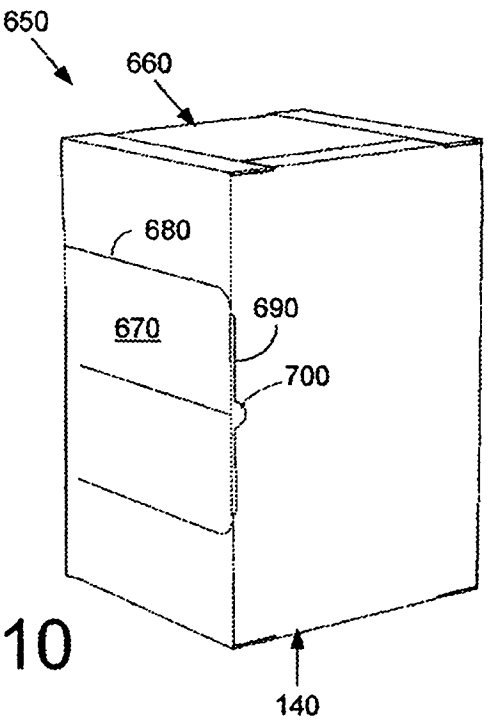
FIG. 10 is a further perspective view of the bliss box of FIG. 9.
Figure 9:
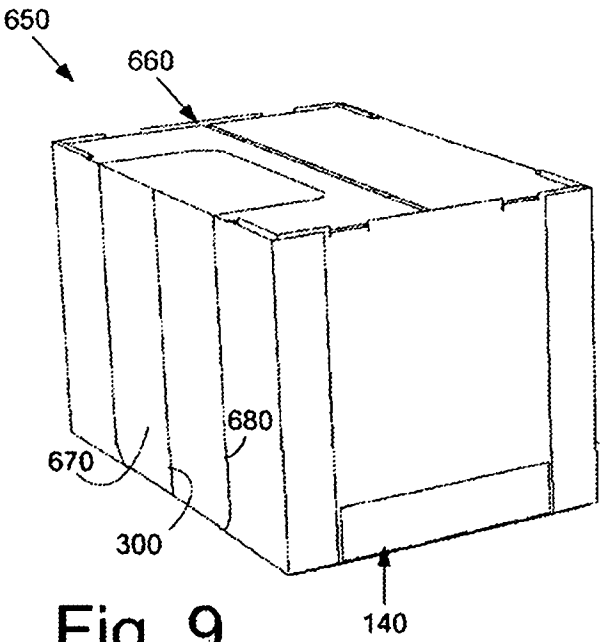
FIG. 9 is a perspective view an example of an alternative embodiment of a bliss box as may be described herein.
Figure 11:
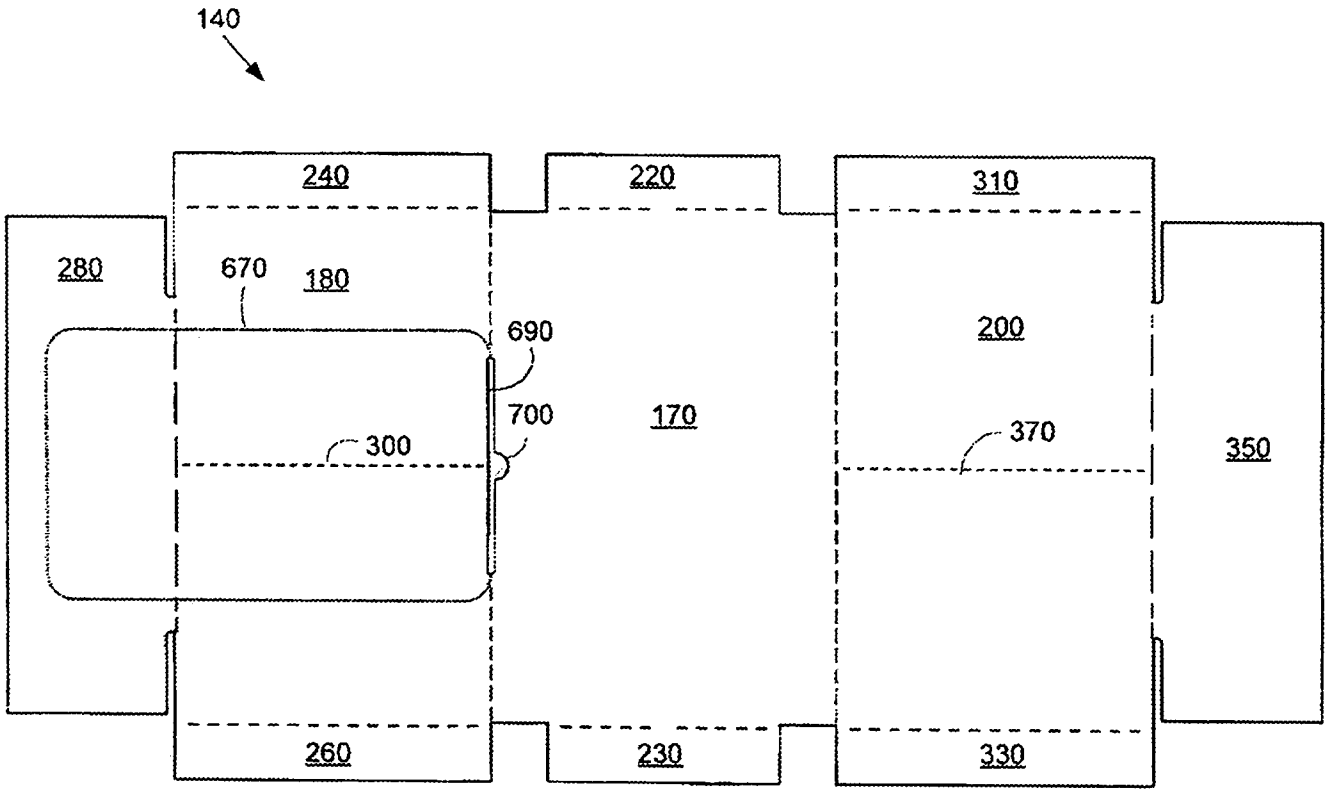
FIG. 11 is a plan view of a body blank that may be used to construct the bliss box of FIG. 10.

FIGS. 9-11 show a further embodiment of a box 650 as may be described herein. As described above, the box 650 may be a bliss-style box 660. The box 650 may be similar to the box 100 described above but with a removable section 670 formed along the first side panel 180 and the first top flap 280 of the body blank 140. The removable section 670 may be formed by a number of removable section fold lines 680 leading to one or more slots 690 and a finger gap 700. The removable section 670 may have a substantially square or oval shape although other shapes may be used herein. The removable section 670 may serve as a display window, an access point to aid in accessing the contents therein, or any type of aperture for any function. Multiple removable sections 670 may be used. The number of slots 690, the offset of the slots 690, the spacing of the slots 690, and the length of the slots 690 may depend on the overall size of the box 650 and other parameters. The slots 690 also may assist in load bearing by laterally distributing the load. Other sizes, shapes, and configurations also may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A multi-piece box, comprising:

a folded body blank forming; the body blank comprising a plurality of body panels;

wherein the body panels comprise a first side panel and a second side panel;

a plurality of folded second blanks forming a plurality of secondary panels;

wherein the plurality of secondary panels comprises a first end panel and a second end panel;

wherein the first end panel comprises first end panel first and second side flaps;

wherein the second end panel comprises second end panel first and second side flaps;

wherein each of the first side panel and the second side panel comprise a first dimension along a first direction;

wherein each of the first end panel, first end panel first side flap, first end panel second side flap, second end panel, second end panel first side flap, and second end panel second side flap comprise a second dimension along the first direction;

wherein the majority of each of the lengths of the first end panel and the second end panel comprise the second dimension along the first direction;

wherein the second dimension is greater than the first dimension;

wherein the first side panel comprises a first top flap, the second side panel comprises a second top flap and wherein the first side panel is partially separated from the first top flap by a first pair of slots and the second side panel is partially separated from the second top flap by a second pair of slots; and wherein the first end panel first side flap and the second end panel first side flap are arranged to be face-to-face with the first side panel and the first end panel second side flap and the second end panel second side flap are arranged to be face-to-face with the second side panel so as to provide a protruding end with respect to the first side panel and the second side panel.

2. The multi-piece box of claim 1, wherein the multi-piece box is a bliss box.

3. The multi-piece box of claim 1, further comprising a corrugated paperboard material.

4. The multi-piece box of claim 1, wherein the plurality of body panels comprise a floor panel.

5. The multi-piece box of claim 4, wherein the first side panel comprises a first pair of side flaps and the second side panel comprises a second pair of side flaps.

6. The multi-piece box of claim 5, wherein the first side panel, second side panel, first pair of side flaps and second pair of side flaps comprise the first dimension.

7. The multi-piece box of claim 1, wherein the first pair of slots and the second pair of slots accommodate the second dimension of the first end panel first and second side flaps and the second end panel first and second side flaps extending therethrough.

8. The multi-piece box of claim 1, wherein the first top flap and the second top flap comprise an angled configuration about the first pair of slots and the second pair of slots.

9. The multi-piece box of claim 1, wherein one or both of the first side panel and the second side panel comprise a removable section therein.

10. The multi-piece box of claim 1, wherein each of the first side panel and the second side panel comprise a vertical fold line.

11. The multi-piece box of claim 1, wherein the first end panel and the second end panel each comprise a top flap.

12. The multi-piece box of claim 11, wherein the first end panel and the second end panel are connected to their respective top flap by one or more recessed hinges.

13. The multi-piece box of claim 1, wherein one or more of the plurality of secondary panels comprise an angled configuration.

14. A multi-piece bliss box, comprising:

a folded body blank forming a plurality of body panels;

wherein the body panels comprise a first side panel, a first side panel first flap, a first side panel second flap, a second side panel, a second side panel first flap and a second side panel second flap;

a first end panel blank and a second end panel blank folded to form a first end panel and a second end panel, respectively;

wherein the first end panel comprises first end panel first and second side flaps and the second end panel comprises second end panel first and second side flaps;

wherein the first side panel comprises a first top flap, the second side panel comprises a second top flap and wherein the first side panel is partially separated from the first top flap by a first pair of slots and the second side panel is partially separated from the second top flap by a second pair of slots; and wherein the first end panel first side flap and the second end panel first side flap are arranged to be face-to-face with the first side panel, the first end panel second side flap and the second end panel second side flap are arranged to be face-to-face with the second side panel, the first side panel first flap and the second side panel first flap are arranged to be face-to-face with the first end panel and the first side panel second flap and the second side panel second flap are arranged to be face-to-face with the second end panel so as to provide a protruding end along the entire lengths of the first end panel first side flap, second end panel first side flap, first end panel second side flap, second end panel second side flap, and majority of each of the lengths of the first and second end panels, with respect to the first and second side panels, first and second side panel first flaps, and the first and second side panel second flaps, respectively.

15. The multi-piece bliss box of claim 14, further comprising a corrugated paperboard material.

16. The multi-piece box bliss box of claim 14, wherein each of the first side panel and the second side panel comprise a vertical fold line.

17. A multi-piece bliss box, comprising:

a first side panel and a second side panel;

a first end panel and a second end panel;

wherein the first side panel comprises first side panel first and second flaps that are both folded to be perpendicular to the first side panel, thereby providing a first corner and a second corner, respectively;

wherein the second side panel comprises second side panel first and second flaps that are both folded to be perpendicular to the second side panel, thereby providing a third corner and a fourth corner, respectively;

wherein the first side panel comprises a vertical fold line between the first corner and second corner;

wherein the second side panel comprises a vertical fold line between the third and fourth corners;

wherein the first side panel comprises a first top flap, the second side panel comprises a second top flap and wherein the first side panel is partially separated from the first top flap by a first pair of slots and the second side panel is partially separated from the second top flap by a second pair of slots;

wherein the first end panel comprises first end panel first and second side flaps and the second end panel comprises second end panel first and second side flaps; and wherein the first end panel first side flap and the second end panel first side flap are arranged to be face-to-face with the first side panel, the first end panel second side flap and the second end panel second side flap are arranged to be face-to-face with the second side panel, the first side panel first flap and the second side panel first flap are arranged to be face-to-face with the first end panel and the first side panel second flap and the second side panel second flap are arranged to be face-to-face with the second end panel so as to provide a protruding end along the entire lengths of the first end panel first side flap, second end panel first side flap, first end panel second side flap, second end panel second side flap, and the majority of each of the lengths of the first and second end panels, with respect to the first and second side panels, first and second side panel first flaps, and the first and second side panel second flaps, respectively.

* * * * *